US009831593B1

(12) United States Patent
Tartaglia

(10) Patent No.: US 9,831,593 B1
(45) Date of Patent: Nov. 28, 2017

(54) NETWORK JACK NODE IDENTIFICATION SYSTEM

(71) Applicant: Shawn Tartaglia, Lake Worth, FL (US)

(72) Inventor: Shawn Tartaglia, Lake Worth, FL (US)

( * ) Notice: Subject to any disclaimer, the term of this patent is extended or adjusted under 35 U.S.C. 154(b) by 0 days.

(21) Appl. No.: 15/187,716

(22) Filed: Jun. 20, 2016

Related U.S. Application Data

(60) Provisional application No. 62/182,441, filed on Jun. 20, 2015.

(51) Int. Cl.

| | |
|---|---|
| ***G08B 13/08*** | (2006.01) |
| ***H01R 13/46*** | (2006.01) |
| ***H01R 24/64*** | (2011.01) |
| *H01R 107/00* | (2006.01) |

(52) U.S. Cl.
CPC ..... *H01R 13/465* (2013.01); *H01R 24/64* (2013.01); *H01R 2107/00* (2013.01)

(58) Field of Classification Search
CPC .. H01R 13/465; H01R 13/641; H01R 9/2475; G08B 13/08; G08B 21/24; G08B 13/1409; F16L 55/48; B61L 5/1863
USPC ..... 439/488, 491; 340/686.1, 686.4, 687, 340/686.2
See application file for complete search history.

(56) References Cited

U.S. PATENT DOCUMENTS

| | | | | |
|---|---|---|---|---|
| 3,911,229 A * | 10/1975 | De Luca | H04M 5/02 | 40/649 |
| 4,704,091 A * | 11/1987 | Owens | H01R 13/465 | 439/281 |
| 4,820,193 A * | 4/1989 | Noorily | H01R 13/465 | 439/488 |
| 5,334,044 A * | 8/1994 | Falossi | H01R 13/465 | 439/447 |
| 5,529,513 A * | 6/1996 | Lee | H01R 13/465 | 439/491 |
| 5,620,335 A * | 4/1997 | Siemon | H01R 13/46 | 439/447 |
| 5,681,183 A * | 10/1997 | Dzmura | H01R 24/542 | 439/491 |
| 5,775,935 A * | 7/1998 | Barna | H01R 13/465 | 174/112 |

(Continued)

*Primary Examiner* — Gary Paumen
(74) *Attorney, Agent, or Firm* — Allen D. Hertz, P.A.; Allen D. Hertz

(57) ABSTRACT

A network jack assembly network connection identification system comprising an identifier receiving cavity extending inward from a surface of a plug body section of the jack and an identifier element designed for insertion into the identifier receiving cavity. The identifier receiving cavity is accessible through any of a sidewall, a top wall, a bottom wall, or a front wall of the plug body section. The cavity may include a lens enabling viewing of the identifier element. The identifier can be a partially or completely colored surface of the identifier element, a shaped feature of the identifier element, etc. The identifier can be a sheet of material, a pin, or any other suitable insertable component. In one variant, the identifier can be formed during installation by reshaping material designated therefore, such as a wax. Alternatively, the identification solution can be applied to a wall plate.

21 Claims, 13 Drawing Sheets

(56) References Cited

U.S. PATENT DOCUMENTS 6,280,238 B1 * 8/2001 Baker ..... H01R 9/2475 439/491
6,283,787 B1 * 9/2001 Chou ..... H01R 13/465 439/488
6,381,643 B1 * 4/2002 Bartfai ..... H04L 43/50 340/502
7,319,383 B2 * 1/2008 Howard ..... G01S 17/00 340/531
7,410,386 B2 * 8/2008 Fabian ..... H01R 13/4367 439/441
7,463,907 B2 * 12/2008 Smith ..... H04B 3/542 455/41.2
7,690,942 B2 * 4/2010 Berg ..... H01R 13/465 439/488
8,014,518 B2 * 9/2011 King ..... H04Q 1/032 340/687
8,165,102 B1 * 4/2012 Vleugels ..... H04W 88/08 370/338
8,369,242 B2 * 2/2013 Potkonjak ..... G01S 5/0226 340/686.1
8,416,071 B2 * 4/2013 Adcook ..... G01S 5/0284 340/539.13
8,604,926 B2 * 12/2013 Nolterieke ..... H04L 41/0873 340/502
2003/0043070 A1 * 3/2003 Soliman ..... H04L 67/18 342/357.48
2006/0105619 A1 * 5/2006 Lanni ..... H01R 13/6456 439/488
2007/0069908 A1 * 3/2007 St-Germain ..... H05B 33/0842 340/686.1
2008/0291042 A1 * 11/2008 Soares, Jr. ..... G05B 15/02 340/686.1
2011/0165792 A1 * 7/2011 Burns ..... H01R 13/465 439/488
2012/0000977 A1 * 1/2012 German ..... H04Q 1/138 235/375
2012/0149234 A1 * 6/2012 Sun ..... H01R 13/7175 439/490
2014/0017934 A1 * 1/2014 Schwarzkopf ..... H01R 4/4836 439/491

* cited by examiner

NETWORK JACK NODE IDENTIFICATION SYSTEM

CROSS REFERENCE TO RELATED APPLICATION

This Non-Provisional Patent Application claims the benefit of U.S. Provisional Patent Application Ser. No. 62/182,441, filed on Jun. 20, 2015, which is incorporated herein by reference in its entirety.

FIELD OF THE INVENTION

The present invention relates to a network jack node location identification system and an associated use thereof, and more particularly, a network jack and/or network jack mounting plate having at least one cavity for receiving a respective insertable identifier.

BACKGROUND OF THE INVENTION

Network jacks are installed throughout a structure for connectivity of electronic devices to a network. The network jacks can be included within a computer network, a telephone network, and the like. The multitude of network jacks deployed within the structure urges an identification system. A commonly utilized identification system is the use of individually printed labels, wherein each printed label would identify if the jack is connected within a data network, a voice network, an entertainment network, and the like. Each jack can be uniquely identified by printing a label and adhering the printed label to the respective wall plate, more specifically, each printed label would also include a unique node identifier, wherein the unique node identifier would index the associated jack with a network switch location. These labels are acceptable for jack wall plates that are installed in obscure locations, but would be considered as unsightly for jack wall plates that are installed in visible locations. Additionally, the labels need to be of a sufficient size to ensure the print is legible for the user. In spite of how neatly each label is printed and shaped, the application of labels is a less than desirable solution. Another drawback of using printed labels is the time required to enter the data for each node, print each label, and secure each label to the wall plate. The nature of the process results in labels which are commonly adhered to the wall plate in a location that is off center and not parallel to an edge of thereof.

Network jacks continue to become more prevalent in both commercial and residential structures. Networks are extending to telephones, televisions, kitchen appliances, other appliances, and the like. With the advancement of electronic devices that utilize networks, network jacks are being more commonplace in visible locations, such as within offices, kitchens, family rooms, living rooms, bathrooms, and the like. The network jacks are being located in more accessible locations, which are commonly more visible.

One partial solution to the identification scenario is the use of colored network jacks. For example, one exemplary installation scheme is the use of blue network jacks to identify telephone jacks and orange network jacks to identify data jacks. The use of colored network jacks can be less than desirable in certain installations, as the color coding would contrast the color of the wall plate, wherein the contrast in color draws unwanted attention to the network jacks.

Accordingly, there remains a need in the art for a system for identifying a network and a network node of a network jack while minimizing any attention drawn to the network jack.

SUMMARY OF THE INVENTION

The present invention overcomes the deficiencies of the known art and the problems that remain unsolved by providing an apparatus, a system, and a respective method for identifying a network and a respective network node associated with a network jack.

In accordance with one embodiment of the present invention, the invention includes a network jack comprising:

network jack body having a front surface, a pair of side surfaces, a top surface, and a bottom surface;

a network connection point integral with the network jack body, wherein the network connection point is adapted to provide signal connectivity with an upstream network, and an outbound signal connector integral with the network jack body, wherein the outbound signal connector is adapted to provide signal connectivity with a downstream device, wherein the network connection point and the outbound signal connector are in signal communication with one another; and at least one jack network location identifier applied to a front surface of the molded network jack body of the network jack assembly, wherein the jack network location identifier is at least one of a color and a three dimensional shape.

In a second aspect, the network jack body comprises at least one identification cavity and a jack network location identifier, wherein the jack network location identifier is adapted for insertion into the identification cavity.

In another aspect, the network jack body comprises a pair of identification cavities. In one application, one of the pair of identification cavities identifies the network and the other of the pair of identification cavities identifies the node within the network.

In yet another aspect, the network jack body comprises multiple identification cavities.

In yet another aspect, the identification cavity extends inward from the side surface of network jack body, the identification cavity having a clear or translucent lens cover integral thereof within a portion of the identification cavity contributing to the front surface of the network jack body.

In yet another aspect, the jack network location identifier is adapted for insertion into the identification cavity extends inward from the side surface of network jack body.

In yet another aspect, the jack network location identifier is adapted for insertion into the identification cavity extends inward from the side surface of network jack body, the jack network location identifier includes an identification surface, wherein the identification surface includes a color coded identifier.

In yet another aspect, the identification cavity extends inward from the front surface of network jack body.

In yet another aspect, the jack network location identifier is adapted for insertion into the identification cavity extends inward from the front surface of network jack body.

In yet another aspect, the jack network location identifier is adapted for insertion into the identification cavity extends inward from the front surface of network jack body, the jack network location identifier comprising an elongated assembly element, wherein the elongated assembly element is shaped and sized for insertion into the identification cavity.

In yet another aspect, the identification cavity further comprises a keyway, wherein the keyway defines an orientation of the jack network location identifier when the elongated assembly element is inserted therein.

In yet another aspect, wherein the identification cavity includes a cross sectional shape that is non-circular in shape and the elongated assembly element includes a cross sectional shape that is non-circular in shape and adapted for insertion into the identification cavity, wherein the cross sectional shape of the identification cavity and respective cross sectional shape of the of elongated assembly element define an orientation of the jack network location identifier when the elongated assembly element is inserted into the identification cavity.

In yet another aspect, the identification cavity further comprises a keyway and the elongated assembly element further comprises a respective orientation key, wherein the keyway and respective orientation key defines an orientation of the jack network location identifier when the elongated assembly element is inserted into the identification cavity.

In yet another aspect, the jack network location identifier is adapted for insertion into the identification cavity extends inward from the front surface of network jack body, wherein an exposed end of the jack network location identifier is color coded to identify the network location associated with the jack assembly.

In yet another aspect, the jack network location identifier is adapted for insertion into the identification cavity extends inward from the front surface of network jack body, wherein an exposed end of the jack network location identifier further includes a three dimensional element formed at a distal end thereof to identify the network location associated with the jack assembly.

In yet another aspect, wherein the three dimensional element formed at a distal end of the jack network location identifier is larger than a diameter of the jack network location identifier.

In accordance with one embodiment of the present invention, the invention includes a network jack comprising:

network jack body having a front surface, a pair of side surfaces, a top surface, and a bottom surface;

a network connection point integral with the network jack body, wherein the network connection point is adapted to provide signal connectivity with an upstream network;

an outbound signal connector integral with the network jack body, wherein the outbound signal connector is adapted to provide signal connectivity with a downstream device;

wherein the network connection point and the outbound signal connector are in signal communication with one another; and at least one three dimensional identification feature, wherein the three dimensional identification feature is decisively non-planar with the front surface of the network jack body.

In yet another aspect, at least one three dimensional identification features is formed as an embossed feature on the front surface of the network jack body, wherein the three dimensional identification feature is provided as a raised design.

In yet another aspect, at least one three dimensional identification features is formed as a debossed feature on the front surface of the network jack body, wherein the three dimensional identification feature is provided as a depressed design.

In accordance with one embodiment of the present invention, the invention includes a network jack wall plate comprising:

network jack wall plate panel having a front surface and a rear surface;

a network jack mounting receptacle extending rearward from the rear surface of the network jack wall plate panel;

a network jack access aperture passing through the network jack wall plate panel, wherein the network jack access aperture is adapted for insertion of a network jack plug receptacle body therethrough;

an identification cavity; and a jack network location identifier, wherein the jack network location identifier is adapted for insertion into the identification cavity.

In yet another aspect, the identification cavity having a clear or translucent lens cover integral thereof within a portion of the identification cavity contributing to the front surface of the network jack wall plate panel, wherein the identification cavity is accessible from the rear side of the wall plate panel and the associated jack network location identifier is slideably inserted therein.

In yet another aspect, the identification cavity and the associated jack network location identifier of the network jack wall plate are provided in any of the previously described variants.

In yet another aspect, the identification cavity is located proximate the network jack access aperture.

In yet another aspect, the network jack wall plate comprising a pair of identification cavities. The pair of identification cavities is located proximate the network jack access aperture.

In yet another aspect, the network jack wall plate comprising:

a plurality of network jack mounting receptacles, each network jack mounting receptacle extending rearward from the rear surface of the network jack wall plate panel;

a plurality of network jack access apertures, each network jack access aperture passing through the network jack wall plate panel and in registration with each network jack mounting receptacle, wherein each network jack access aperture is adapted for insertion of an associated network jack plug receptacle body therethrough; and at least one identification cavity located proximate to each associated network jack access aperture.

In yet another aspect, the quantity network jack mounting receptacles of the plurality of network jack mounting receptacles and associated network jack access aperture is one of: one (1), two (2), three (3), four (4), six (6), or eight (8) per wall plate.

In accordance with a first method of applying the present invention, a method of identifying a network location of a network jack assembly, the method comprising steps of:

obtaining a network jack assembly, comprising:

a molded network jack body having a front surface, a pair of side surfaces, a top surface, and a bottom surface, a network connection point integral with the network jack body, wherein the network connection point is adapted to provide signal connectivity with an upstream network, and an outbound signal connector integral with the network jack body, wherein the outbound signal connector is adapted to provide signal connectivity with a downstream device, wherein the network connection point and the outbound signal connector are in signal communication with one another, connecting the network connection point of the network jack assembly to a node within a network;

selecting at least one jack network location identifier having at least one of a color and a three dimensional shape associated with the at least one of the network and the node within the network to which the network connection point of the network jack assembly is connected to;

employing the selected at least one jack network location identifier to identify at least one of the network and the node within the network to which the network connection point of the network jack assembly is connected to; and applying the selected at least one jack network location identifier to the molded network jack body of the network jack assembly, wherein the jack network location identifier is at least one of a color and a three dimensional shape.

In a second aspect, the network jack body further comprising at least one jack network identification cavity, the at least one jack network location identifier is adapted for insertion into the identification cavity, the method further comprises steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the network jack body.

In another aspect, the network jack body further comprising at least one jack network identification cavity extending inward from the front surface of network jack body, each of the at least one jack network location identifier comprising a feature that has a shape and size adapted for insertion into the at least one jack network identification cavity, the method further comprises steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the network jack body.

In yet another aspect, the network jack body further comprising at least one jack network identification cavity extending inward from the front surface of network jack body, the jack network location identifier comprising an identification feature disposed upon a visible end of an elongated assembly element, the elongated assembly element having a shape and size adapted for insertion into the at least one jack network identification cavity, the method further comprising steps of:

selecting the at least one jack network location identifier comprising the identification feature having at least one of the color and the three dimensional shape associated with the at least one of the network and the node within the network to which the network connection point of the network jack assembly is connected to; and inserting the elongated assembly element of the selected at least one jack network location identifier into one of the at least one jack network identification cavity formed within the network jack body.

In yet another aspect, the network jack body further comprising at least one jack network identification cavity extending inward from the side surface of network jack body, the jack network location identifier comprising having a shape and size adapted for insertion into the at least one jack network identification cavity, the method further comprising steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the network jack body.

In yet another aspect, the network jack body further comprising at least one jack network identification cavity extending inward from the side surface of network jack body, a cavity lens cover integral to a portion of the identification cavity contributing to the front surface of the network jack body, the jack network location identifier comprising having a shape and size adapted for insertion into the at least one jack network identification cavity, the method further comprising steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the network jack body, where the selected at least one jack network location identifier is visible through the cavity lens cover.

In yet another aspect, the network jack body further comprising at least one three dimensional shape formed upon the front surface of the network jack body, the method further comprising steps of:

employing the at least one three dimensional shape formed upon the front surface of the network jack body as the at least one jack network location identifier; and selecting the network jack assembly having the at least one jack network location identifier having the three dimensional shape associated with the at least one of the network and the node within the network to which the network connection point of the network jack assembly is connected to.

In yet another aspect, the network jack body further comprising at least one three dimensional shape formed upon the front surface of the network jack body, the method further comprising steps of:

applying a color to the at least one three dimensional shape;

employing at least one of color and the at least one three dimensional shape formed upon the front surface of the network jack body as the at least one jack network location identifier; and selecting the network jack assembly having the at least one jack network location identifier having the three dimensional shape associated with the at least one of the network and the node within the network to which the network connection point of the network jack assembly is connected to.

In accordance with a second method of applying the present invention, a method of identifying a network location of a network jack assembly, the method comprising steps of:

obtaining a network jack assembly, comprising:

a molded network jack body having a front surface, a pair of side surfaces, a top surface, and a bottom surface, a network connection point integral with the network jack body, wherein the network connection point is adapted to provide signal connectivity with an upstream network, and an outbound signal connector integral with the network jack body, wherein the outbound signal connector is adapted to provide signal connectivity with a downstream device, wherein the network connection point and the outbound signal connector are in signal communication with one another, connecting the network connection point of the network jack assembly to a node within a network;

selecting at least one jack network location identifier having at least one of a color and a three dimensional shape associated with the at least one of the network and the node within the network to which the network connection point of the network jack assembly is connected to;

employing the selected at least one jack network location identifier to identify at least one of the network and the node within the network to which the network connection point of the network jack assembly is connected to; and inserting the selected at least one jack network location identifier into one of the at least one jack network identification cavity of the molded network jack body of the network jack assembly, wherein the jack network location identifier is at least one of a color and a three dimensional shape.

In accordance with another method of applying the present invention, a method of identifying a network location of a network jack assembly, the method comprising steps of:

obtaining a network jack assembly, comprising:

a molded network jack body having a front surface, a pair of side surfaces, a top surface, and a bottom surface, a network connection point integral with the network jack body, wherein the network connection point is adapted to provide signal connectivity with an upstream network, and an outbound signal connector integral with the network jack body, wherein the outbound signal connector is adapted to provide signal connectivity with a downstream device, wherein the network connection point and the outbound signal connector are in signal communication with one another, obtaining a network jack assembly wall plate, comprising:

a wall plate body, and at least one jack assembly access port formed through the wall plate body;

assembling the network jack assembly to one of the at least one jack assembly access port of the wall plate body;

connecting the network connection point of the network jack assembly to a node within a network;

selecting at least one jack network location identifier having at least one of a color and a three dimensional shape associated with the at least one of the network and the node within the network to which the network connection point of the network jack assembly is connected to;

employing the selected at least one jack network location identifier to identify at least one of the network and the node within the network to which the network connection point of the network jack assembly is connected to; and applying the selected at least one jack network location identifier to one of the molded network jack body of the network jack assembly and the wall plate body, wherein the jack network location identifier is at least one of a color and a three dimensional shape.

In a second aspect, the at least one of the network jack body and the wall plate body further comprising at least one jack network identification cavity, the at least one jack network location identifier is adapted for insertion into the identification cavity, the method further comprising steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the at least one of the network jack body and the wall plate body.

In another aspect, the at least one of the network jack body and the wall plate body further comprising at least one jack network identification cavity extending inward from the front surface of the at least one of the network jack body and a front surface of the wall plate body, each of the at least one jack network location identifier comprising a feature that has a shape and size adapted for insertion into the at least one jack network identification cavity, the method further comprising steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the at least one of the network jack body and the wall plate body.

In yet another aspect, the network jack body further comprising at least one jack network identification cavity extending inward from at least one of the front surface of network jack body and a front surface of the wall plate body, the jack network location identifier comprising an identification feature disposed upon a visible end of an elongated assembly element, the elongated assembly element having a shape and size adapted for insertion into the at least one jack network identification cavity, the method further comprising steps of:

selecting the at least one jack network location identifier comprising the identification feature having at least one of the color and the three dimensional shape associated with the at least one of the network and the node within the network to which the network connection point of the network jack assembly is connected to; and inserting the elongated assembly element of the selected at least one jack network location identifier into one of the at least one jack network identification cavity formed within the network jack body.

In yet another aspect, the at least one of the network jack body and the wall plate body further comprising at least one jack network identification cavity extending inward from the side surface of network jack body and a side of the wall plate body, the jack network location identifier comprising having a shape and size adapted for insertion into the at least one jack network identification cavity, the method further comprising steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the at least one of the network jack body and the wall plate body.

In yet another aspect, the at least one of the network jack body and the wall plate body further comprising at least one jack network identification cavity extending inward from the side surface of network jack body, a cavity lens cover integral to a portion of the identification cavity contributing to the front surface of the network jack body, the jack network location identifier comprising having a shape and size adapted for insertion into the at least one jack network identification cavity, the method further comprising steps of:

selecting the at least one jack network location identifier having the at least one of the color and the three dimensional shape associated with the at least one of the network and the node within the network to which the network connection point of the network jack assembly is connected to; and inserting the selected at least one jack network location identifier into one of the at least one jack network identification cavity formed within the at least one of the network jack body and the wall plate body, where the selected at least one jack network location identifier is visible through the cavity lens cover.

In yet another aspect, the at least one of the network jack body and the wall plate body further comprising at least one three dimensional shape formed upon at least one of the front surface of the network jack body and a front surface of the wall plate body, the method further comprising steps of:

employing the at least one three dimensional shape formed upon at least one of the front surface of the network jack body and the front surface of the wall plate body as the at least one jack network location identifier; and selecting the at least one of the network jack body and the wall plate body having the at least one jack network location identifier having the three dimensional shape associated with the at least one of the network and the node within the network to which the network connection point of the network jack assembly is connected to.

In yet another aspect, the at least one of the network jack body and the wall plate body further comprising at least one three dimensional shape formed upon at least one of the front surface of the network jack body and a front surface of the wall plate body, the method further comprising steps of:

applying a color to the at least one three dimensional shape;

employing at least one of color and the at least one three dimensional shape formed upon the front surface of the network jack body as the at least one jack network location identifier; and selecting the at least one of the network jack body and the wall plate body having the at least one jack network location identifier having the three dimensional shape associated with the at least one of the network and the node within the network to which the network connection point of the network jack assembly is connected to.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE PRESENT INVENTION

Figure 1:
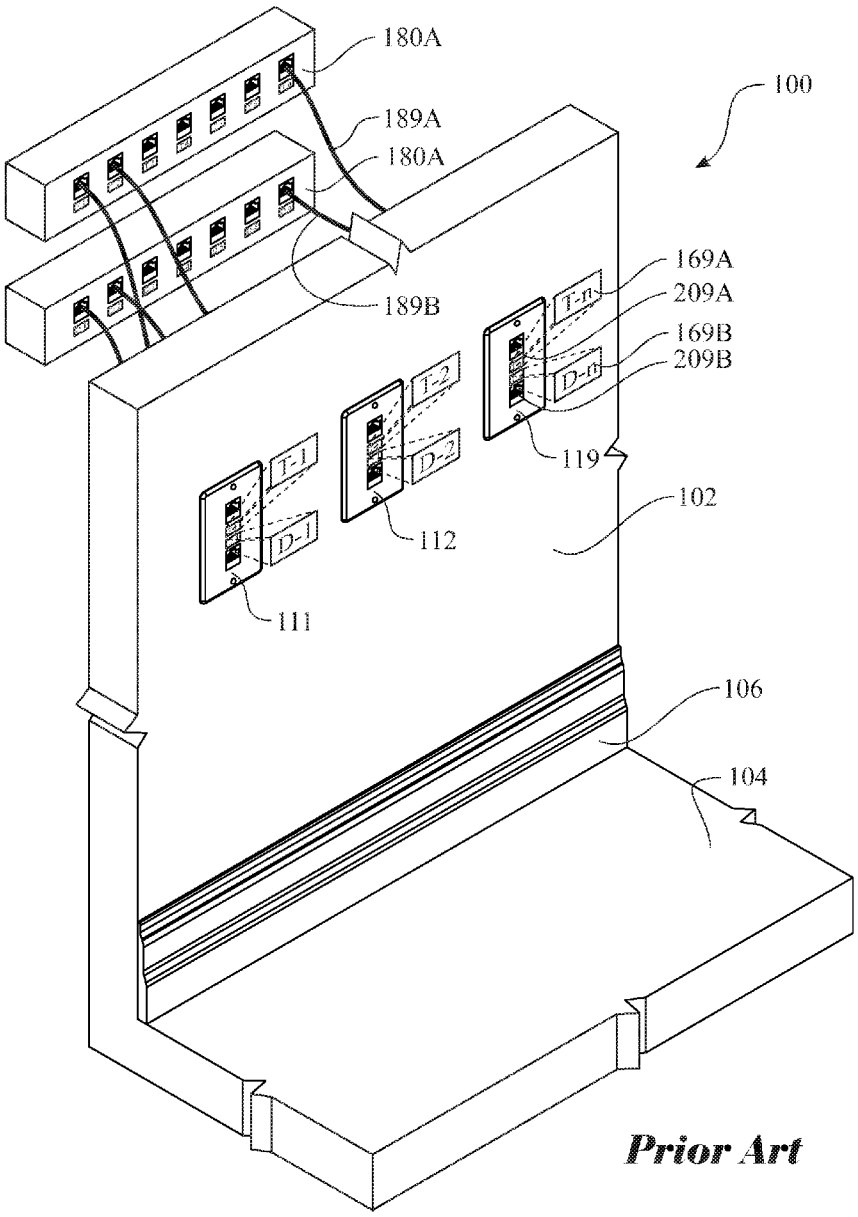
Prior Art FIG. 1
FIG. 1 presents an isometric view illustrating an exemplary arrangement of a plurality of network jack wall plates installed in a wall of an exemplary commercial or residential structure in accordance with known prior art.

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
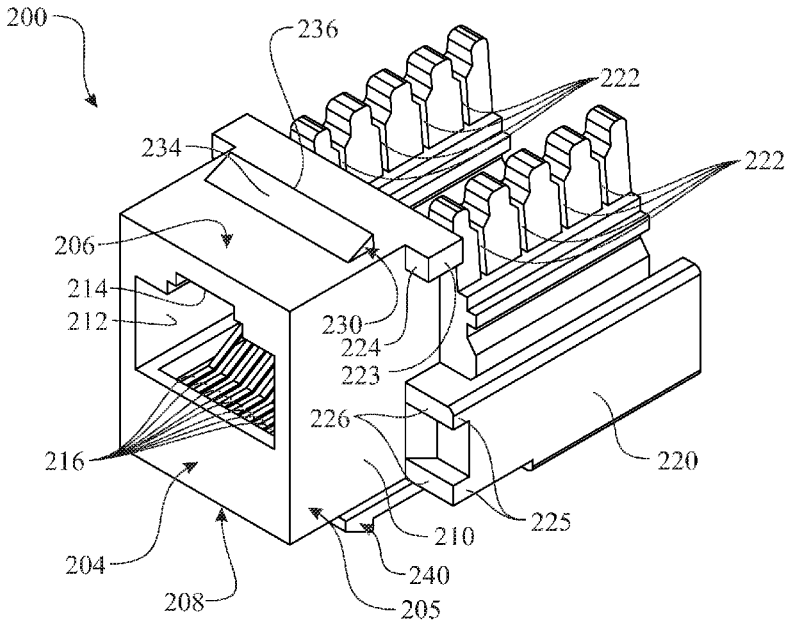
Prior Art FIG. 2
FIG. 2 presents an isometric view illustrating an exemplary network jack assembly, more specifically an exemplary keystone jack assembly in accordance with known prior art.

Network connectivity has been a fundamental implement for business associates and home use. The network connectivity can include access to a telephone landline, an Internet, a local network, entertainment (television, video, audio, etc.), and the like. An exemplary installation in accordance with the known process is presented in FIG. 1. The exemplary illustration presents a room section 100, wherein the room section 100 is representative of one or more room sections 100 of a residential structure, a commercial structure, a park, a sports facility, or any other deployment of a network. The room section 100 includes a wall 102 extending upward from a flooring 104. A transition between the wall 102 and the flooring 104 can be accented by a baseboard 106. In an alternative embodiment, the flooring 104 would be representative of a countertop, a shelf, a desktop, or any other horizontally oriented surface. Similarly, the wall 102 would be representative of any vertically oriented surface. The exemplary embodiment is representative of any number of network jack outlets (numbered as 1, 2, . . . n). Each exemplary wall plate 111, 112, 119 includes a pair of network jack assemblies 200 (detailed in the illustration shown in FIG. 2), represented by an exemplary first jack assembly 209A and an exemplary second jack assembly 209B.

Each network includes a network switch 180A, 180B or other form of network interface component, a plurality of installed network jack assemblies 200 and a signal communication link 189A, 189B provided between each of the plurality of installed network jack assemblies 200 and the respective type of collection point 180A, 180B.

The network jacks 200 are commonly of the same shape and size making identification of the connection purpose of specific network jack 200 within the network difficult. Configuring the network commonly includes installation of a plurality of network jack assemblies 200 installed about the area. The similarity between network jacks 200 can complicate use and troubleshooting of the system. One common method used for identifying each type of network and network node associated with each network jack 200 is to print an identifier onto a label forming a jack assembly identifier 169A, a second jack assembly identifier 169B and secure the jack assembly identifiers 169A, 169B to the respective wall plate 119 as identified in the exemplary illustration. With the expanded use of networks in both residential and commercial applications, appearance of the identification system (more specifically, the jack assembly identifier 169A and the second jack assembly identifier 169B) is becoming a more significant factor.

Figure 13:
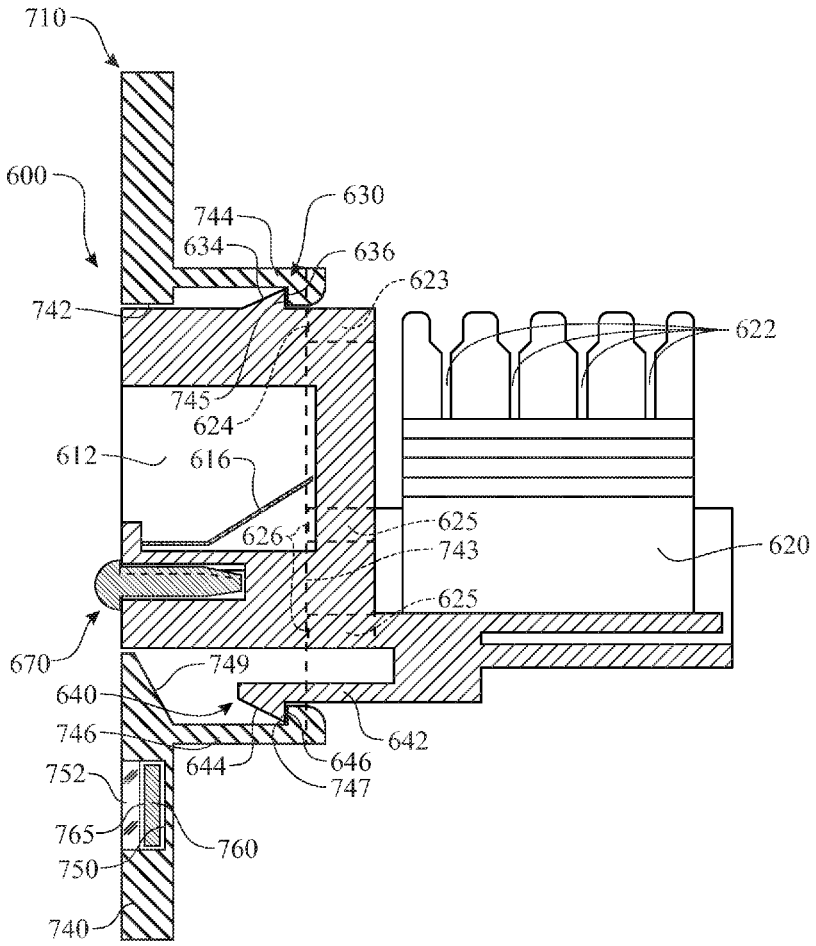
FIG. 13 presents a cross sectioned elevation side view of an exemplary network jack wall plate, introducing a network identification cavity integral therein.

The present invention is an improvement over the existing network jack assembly 200. The network jack assembly 200 can be segmented into a plug body section 210 and a terminal body section 220. The plug body section 210 includes features for connectivity with an electronic device by receiving a plug of a cable. The terminal body section 220 includes features for connectivity to the network 180A, 180B, such as through wiring of a respective cable, connection of a second plug, and the like. Orientation of the plug body section 210 can be defined as having a network jack assembly front surface 204, a pair of network jack assembly side surfaces 205 a network jack assembly top surface 206, and a network jack assembly bottom surface 208. The network jack assembly front surface 204 defines the exposed face of the network jack assembly 200. The network jack assembly side surfaces 205, network jack assembly top surface 206, and network jack assembly bottom surface 208 extend rearward from a peripheral edge of the network jack assembly front surface 204, creating a depth of the plug body section 210. A plug receptacle 212 extends inward from the network jack assembly front surface 204. A receptacle keyway and latch 214 can be included in the plug receptacle 212, where the receptacle keyway and latch 214 provides a function defining an orientation of the plug (not shown) when inserted and a latching function for temporarily securing the plug within the plug receptacle 212. Signal connectivity between the network jack assembly 200 and the inserted plug is provided through a series of receptacle contacts 216. Each of the series of receptacle contacts 216 is connected and spatially arranged in accordance with established industry standards, more specifically IEEE 802.3. Each of the series of receptacle contacts 216 is provided in signal connection with a respective terminal 222 of a series of terminals 222. The series of terminals 222 can be provided in any suitable design, such as a friction insertion contact shown. The network jack assembly 200 is assembled to the wall plate 111, 112, 119. The network jack assembly 200 includes features for removably retaining the network jack assembly 200 to the respective wall plate 111, 112, 119. One exemplary implementation employs a pair of compression retention features 230, 240 in combination with a series of tensile retention features 223, 225. The fixed jack assembly plate retention feature 230 is rigidly integrated into the plug body section 210, such as the terminal body section 220 extending proud from the network jack assembly top surface 206. The fixed jack assembly plate retention feature 230 includes a fixed jack assembly plate retention feature lead in surface 234, wherein the fixed jack assembly plate retention feature lead in surface 234 is angled rearward to aid in an insertion of the fixed jack assembly plate retention feature 230 into a network jack receiving frame of the wall plate 111, 112, 119. A fixed jack assembly plate retention feature compression resistance surface 236 is formed on a trailing edge of the fixed jack assembly plate retention feature 230, wherein the fixed jack assembly plate retention feature 230 is substantially vertically oriented to retain the network jack assembly 200 within the wall plate 111, 112, 119 against a compression or rearwardly applied force. The cantilevered jack assembly plate retention feature 240 is cantilevered from the plug body section 210, enabling flexure of a distal end thereof. The distal end of the cantilevered jack assembly plate retention feature 240 includes features similar to the fixed jack assembly plate retention feature 230 to provide a second location of retention. The fixed jack assembly plate retention feature 230 and the cantilevered jack assembly plate retention feature 240 are commonly integrated on opposite surfaces of the plug body section 210. The tensile retention features 223, 225 include surfaces 224, 226 to retain the network jack assembly 200 in position against a tensile or forwardly applied force. Essentially, a wall plate body 740 (FIG. 13) of the wall plate is sandwiched between the compression retention surfaces 236 and a similar surface on the cantilevered jack assembly plate retention feature 240 and the tensile retention surfaces 224, 226.

The present invention modifies the current network jack assembly 200 by introducing at least one identifier receiving cavity. It is understood that there are a number of variants to the proposed invention, with several variants being disclosed herein.

Figure 3:
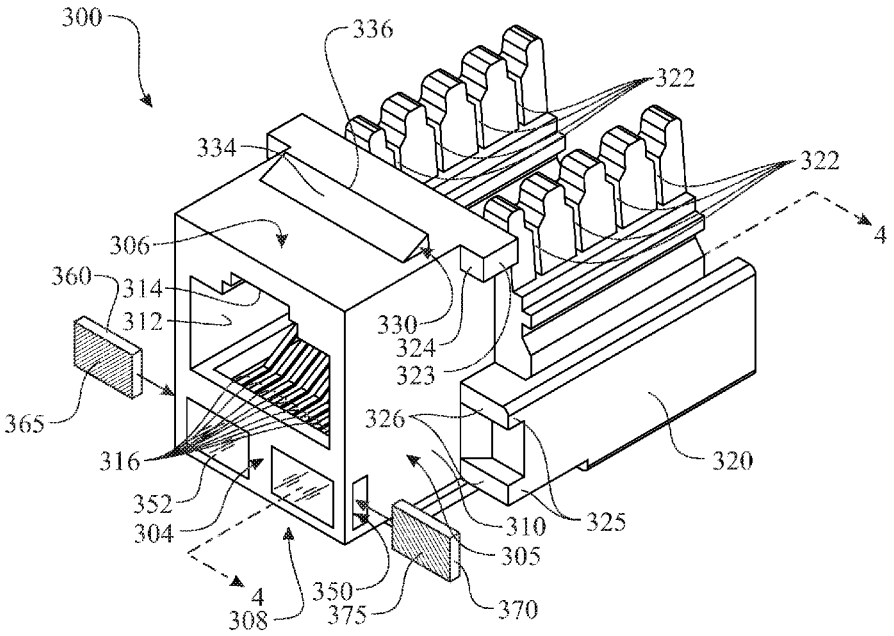
FIG. 3 presents an isometric view illustrating an exemplary network jack assembly comprising a pair of network node identification cavities in accordance with the present invention, wherein the network node identification cavities are accessible through a side surface of the network jack assembly.
Figure 4:
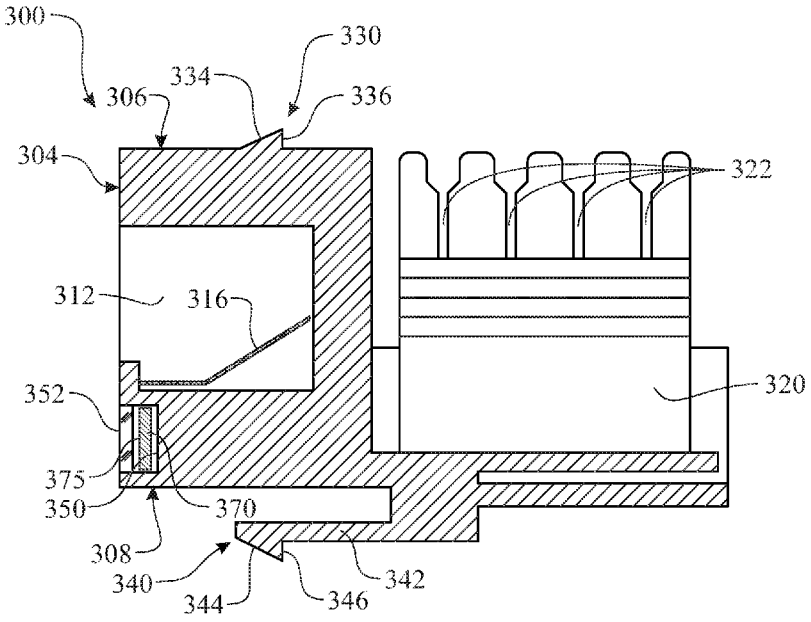
FIG. 4 presents a cross sectioned elevation side view of the exemplary network jack assembly originally introduced in FIG. 3, wherein the section is taken along section line 4-4 of FIG. 3.

A first variant, referred to as a network jack assembly 300, is illustrated in an isometric view presented in FIG. 3 and illustrated in a sectioned view presented in FIG. 4, wherein the section is taken along section line 4-4 of FIG. 3. The exemplary network jack assembly 300 is referred to as a keystone jack. It is understood that the network jack assembly 300 is representative of any network jack or other network connection receptacle suitable for employment of the present invention. This can include Ethernet connection receptacles, telephone connection receptacles, entertainment connection receptacles, and the like. The network jack assembly 300 is an adaptation of the present invention to the network jack assembly 200. Like features of the network jack assembly 300 and the network jack assembly 200 are numbered the same, wherein the reference numbers are preceded by the numeral "3".

An identifier receiving cavity 350 is formed extending inward from each respective jack assembly side surface 305. The placement of the opening of the identifier receiving cavity 350 being in the jack assembly side surface 305 provides a significant advantage to the system. When the network jack assembly 300 is installed into the wall plate 111, 112, 119, the side panels of the network jack receiving frame retain the identifier elements 360, 370 within the identifier receiving cavity 350.

An identifier element 360, 370 is selected from an inventory of identifier elements 360, 370, wherein the selected identifier element 360, 370 has an identifier element colored surface 365, 375 unique to the others within the network. As illustrated in the exemplary embodiment, the network jack assembly 300 preferably includes at least two identifier receiving cavities 350, wherein a combination of the first identifier element 360 and the second identifier element 370 significantly increases the uniqueness for identification of a network connection of the specific network jack assembly 300. The installer would insert the selected identifier elements 360, 370 into the respective identifier receiving cavity 350. It is understood that as the number of identifier receiving cavities 350 increases, the number of unique combinations increases exponentially.

An identifier receiving cavity lens 352 is integrated into the network jack assembly 300 to provide visibility of the identifier element colored surfaces 365, 375 to the end user. The identifier receiving cavity lens 352 may be permanently affixed to the plug body section 310. The identifier receiving cavity lens 352 is a clear or translucent lens cover integral with the identifier receiving cavity 350, located within a portion of the identifier receiving cavity 350 that contributes to the front surface 304 of the plug body section 310. The identifier receiving cavity lens 352 provides visibility to identifier element colored surfaces 365, 375 of an identifier elements 360, 370 that are inserted into each respective identifier receiving cavity 350. It is understood that the identifier element colored surfaces 365, 375 can have an exposed surface that is completely covered in a single color, partially colored in a single color, covered in two or more different colors, include shaped images, and the like to easily and readily identify the location of the network jack assembly 300 within the respective network.

The various images can be referred to as an identification feature. The inclusion of two or more identifier elements 360, 370 enable the user to select any combination of identification features to create a unique node identifier. The inventory would include sets of identifier elements 360, 370 having like unique node identifiers, each set would be used for identifying one node.

It is noted, the exemplary illustration in FIG. 4 introduces detailed features of a cantilevered jack assembly plate retention feature 340, which were not previously introduced with the network jack assembly 200. These features include a cantilevered jack assembly plate retention feature lead in surface 344 and a cantilevered jack assembly plate retention feature compression resistance surface 346 formed at a distal end of a cantilevered jack assembly plate retention feature cantilever arm 342.

One skilled in the art would appreciate variants in design and implementation of the network jack assembly 300. One exemplar variance would be the location of the opening of the identifier receiving cavity 350. In an alternative design, the opening of the identifier receiving cavity 350 can be located on the jack assembly top surface 306 or the jack assembly bottom surface 308. The fixed jack assembly plate retention feature 330 and cantilevered jack assembly plate retention feature 340 can be associated with the jack assembly top surface 306 and jack assembly bottom surface 308 respectively as illustrated or on each respective jack assembly side surface 305.

Figure 5:
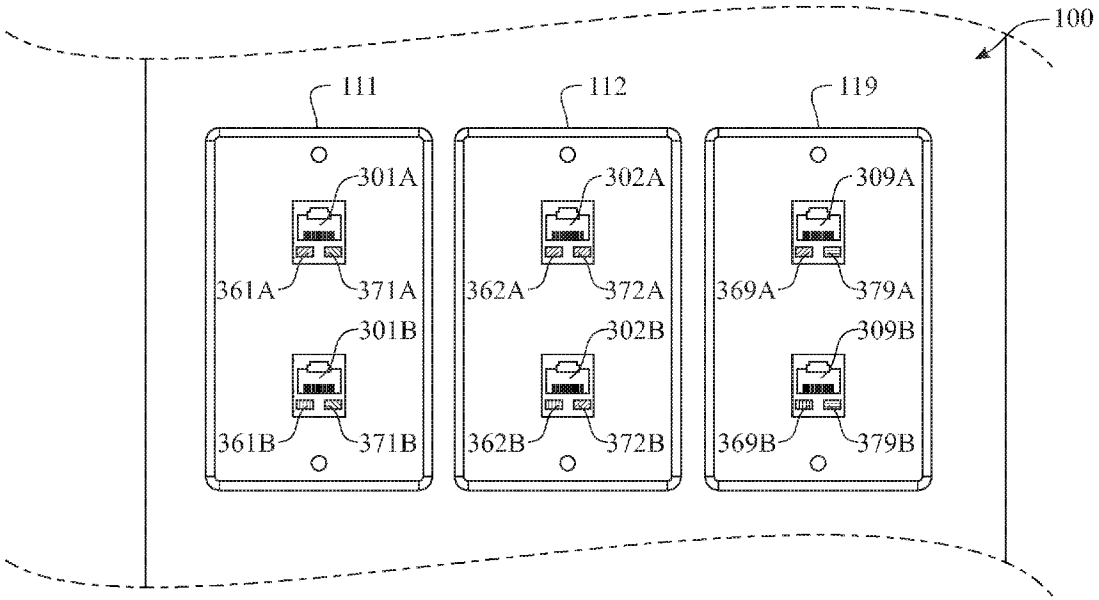
FIG. 5 presents a front view of a series of network jack assemblies introduced in FIG. 3 installed into a plurality of network jack wall plates, wherein the illustration introduces a method of identifying each network and more specifically each associated node of the network to which the network jack assembly is connected thereto.

An exemplary implementation of the network jack assembly 300 is illustrated in FIG. 5. The exemplary illustration presents a series of exemplary wall plates, more specifically, a first wall plate 111, a second wall plate 112 and an nth wall plate 119. Each exemplary wall plate 111, 112, 119 includes a pair of network jack assembly 300, each network jack assembly 300 being identified specifically as a first wall plate, first jack assembly 301A, a second wall plate, first jack assembly 302A, a nth wall plate, first jack assembly 309A, a first wall plate, second jack assembly 301B, a second wall plate, second jack assembly 302B, and a nth wall plate, second jack assembly 309B. Each network connection location of each network jack assembly 300 is identified by a respective first identifier element 360 and a respective second identifier element 370.

Regarding the connection identifies of the network jack assemblies 300 of the first wall plate 111: The first wall plate, first jack assembly 301A of the first wall plate 111 is identified by a first wall plate, first identifier element of first jack assembly 361A and a first wall plate, second identifier element of first jack assembly 371A. The first wall plate, second jack assembly 301B of the first wall plate 111 is identified by a first wall plate, first identifier element of first jack assembly 361B and a first wall plate, second identifier element of first jack assembly 371B.

Regarding the connection identifies of the network jack assemblies 300 of the second wall plate 112: The second wall plate, first jack assembly 302A of the second wall plate 112 is identified by a second wall plate, first identifier element of first jack assembly 362A and a second wall plate, second identifier element of first jack assembly 372A. The second wall plate, second jack assembly 302B of the second wall plate 112 is identified by a second wall plate, first identifier element of first jack assembly 362B and a second wall plate, second identifier element of first jack assembly 372B.

Regarding the connection identifies of the network jack assemblies 300 of the nth wall plate 119: The nth wall plate, first jack assembly 309A of the nth wall plate 119 is identified by an nth wall plate, first identifier element of first jack assembly 369A and an nth wall plate, second identifier element of first jack assembly 379A. The nth wall plate, second jack assembly 309B of the nth wall plate 119 is identified by an nth wall plate, first identifier element of first jack assembly 369B and an nth wall plate, second identifier element of first jack assembly 379B.

Figure 6:
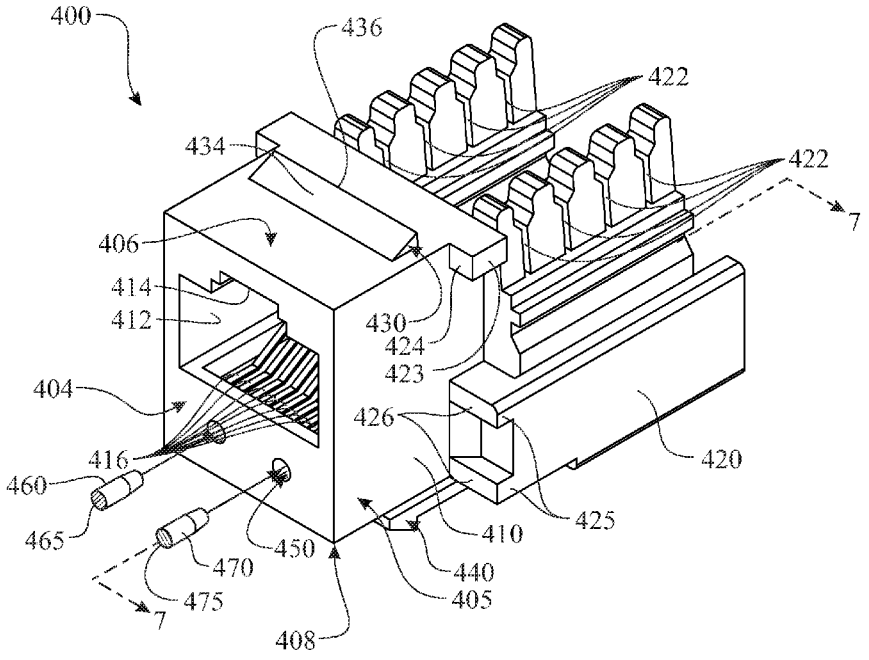
FIG. 6 presents an isometric view illustrating an exemplary variant of the network jack assembly introduced in FIG. 3, wherein the network node identification cavities are accessible through a front surface of the network jack assembly.
Figure 7:
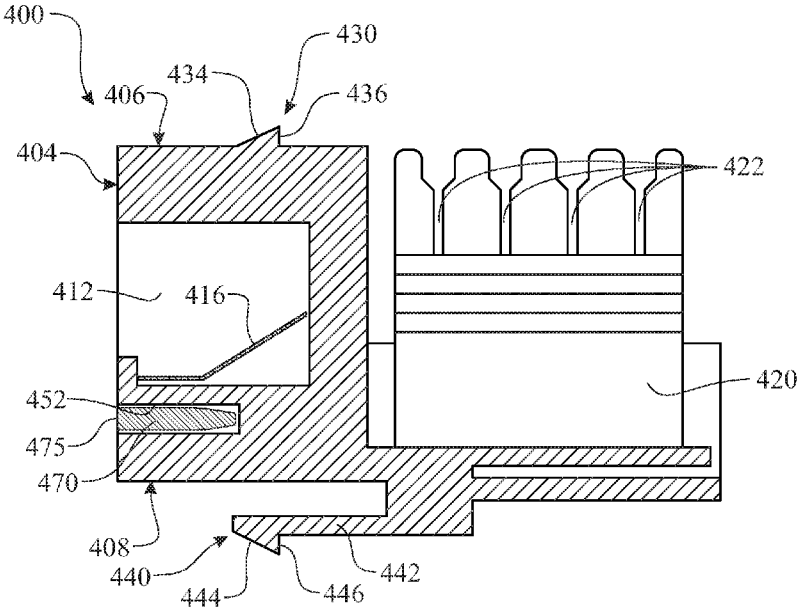
FIG. 7 presents a cross sectioned elevation side view of the exemplary network jack assembly originally introduced in FIG. 6, wherein the section is taken along section line 7-7 of FIG. 6.

A second variant, referred to as a network jack assembly 400, is illustrated in an isometric view presented in FIG. 6 and illustrated in a sectioned view presented in FIG. 7, wherein the section is taken along section line 7-7 of FIG. 6. The network jack assembly 400 is a second adaptation of the present invention to the network jack assembly 200. Like features of the network jack assembly 400 and the network jack assembly 300 are numbered the same, wherein the reference numbers are preceded by the numeral "4".

An identifier receiving cavity 450 is formed extending inward from the jack assembly front surface 404. The placement of the opening of the identifier receiving cavity 450 being in the jack assembly front surface 404 is a result of the design and function of identifier elements 460, 470. Each identifier element 460, 470 is selected from an inventory of identifier elements 460, 470, wherein the selected identifier element 460, 470 has an identifier element colored surface 465, 475 unique to the others within the network. The identifier element colored surface 465, 475 is provided at a proximal end of an elongated body of the identifier element 460, 470. It is understood that the identifier element colored surface 465, 475 can be pre-colored, provided by a coloration of the material of the identifier element 460, 470, or colored by the installer.

The elongated body of the identifier element 460, 470 would have a cross sectional shape that is adapted for insertion into the cross sectional shape of the identifier receiving cavity 450. The preferred cross sectional shape of the identifier element 460, 470 would mimic the cross sectional shape of the identifier receiving cavity 450. Although the exemplary embodiment presents each identifier receiving cavity 450 having a circular cross sectional shape, it is understood that the identifier receiving cavity 450 can have any suitable cross sectional shape. It is understood that a non-circular cross sectional shape would define an orientation of the identifier element 460, 470 when inserted into the identifier receiving cavity 450. Additionally, each identifier receiving cavity 450 of a plurality of identifier receiving cavities 450 can have a unique cross sectional shape. For example, one identifier receiving cavity 450 can have a "T" shaped cross sectional shape, representative of a telephony network connection and a second identifier receiving cavity 450 can have a "D" shaped cross sectional shape, representative of a data network connection.

As illustrated in the exemplary embodiment, the network jack assembly 400 preferably includes at least two identifier receiving cavities 450, wherein a combination of the first identifier element 460 and the second identifier element 470 significantly increases the uniqueness for identification of a network connection of the specific network jack assembly 400. The installer would insert the selected identifier elements 460, 470 into the respective identifier receiving cavity 450. The identifier element 460, 470 can be of a length respective to a depth of the identifier receiving cavity 450 to predefine a final position of the proximal surface of the elongated shaft of the identifier element 460, 470 respective to the jack assembly front surface 404. The proximal surface of the elongated shaft of the identifier element 460, 470 can be flush with the jack assembly front surface 404 (as shown in FIG. 7), recess internally from the jack assembly front surface 404, or remaining proud of the jack assembly front surface 404.

Figure 8:
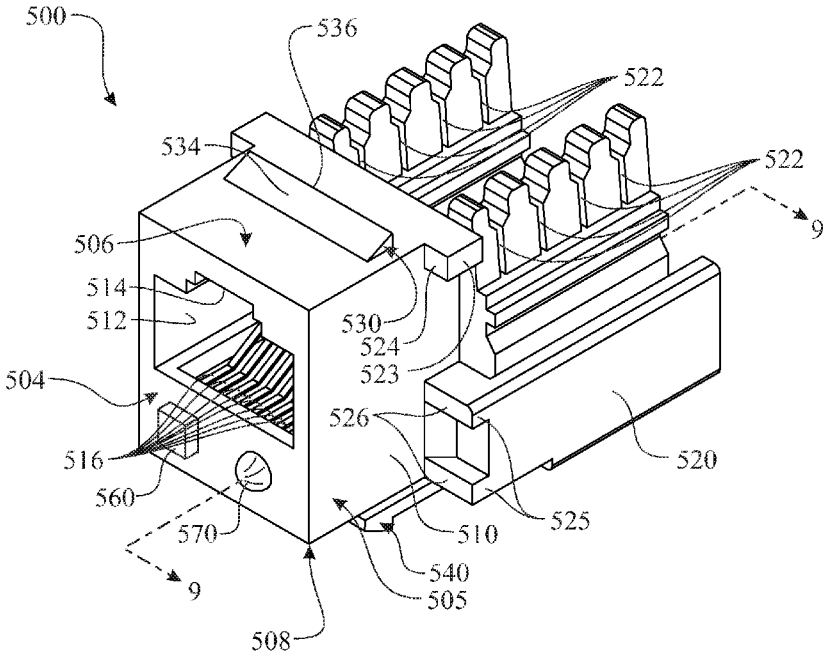
FIG. 8 presents an isometric view illustrating another exemplary variant of the network jack assembly introduced in FIG. 3, wherein the network node identification features are provided as three dimensional formations provided on a front surface of the network jack assembly.
Figure 9:
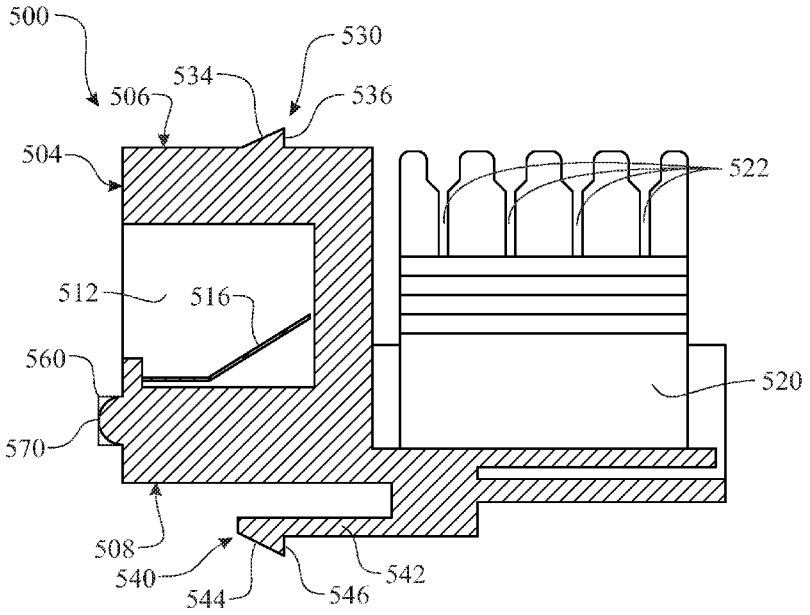
FIG. 9 presents a cross sectioned elevation side view of the exemplary network jack assembly originally introduced in FIG. 8, wherein the section is taken along section line 9-9 of FIG. 8.

A third variant, referred to as a network jack assembly 500, is illustrated in an isometric view presented in FIG. 8 and illustrated in a sectioned view presented in FIG. 9, wherein the section is taken along section line 9-9 of FIG. 8. The network jack assembly 500 is a third adaptation of the present invention to the network jack assembly 200. Like features of the network jack assembly 500 and the network jack assembly 300 are numbered the same, wherein the reference numbers are preceded by the numeral "5".

The network jack assembly 500 varies from the network jack assembly 300, 400 by an inclusion of a three dimensional formed element 560, 570 upon a jack assembly front surface 504 of the network jack assembly 500. The three dimensional formed element 560, 570 would vary from network jack assembly 500 to network jack assembly 500. Each network jack assembly 500 can include one or more three dimensional formed elements 560, 570. Each network jack assembly 500 would have a unique combination of shapes of the three dimensional formed elements 560, 570. Examples of three dimensionally formed surfaces 560, 570 include circular shapes, hemispherical shapes, triangular shapes, square shapes, diamond shapes, pyramid shapes, trapezoidal shapes, pentagonal shapes, hexagonal shapes, octagonal shapes, five point star shapes, six point star shapes, and the like. The three dimensionally formed surfaces 560, 570 enables identification by visual inspection, tactile or feel, and the like.

The three dimensional formed elements 560, 570 can be included in a forming process of the body of the network jack assembly 500, created during a secondary process, added using a bonding process, adhesively attached to the body of the network jack assembly 500 by an installer, and the like. The three dimensional formed elements 560, 570 can be embossed, wherein the three dimensional identification feature is provided as a raised design, or bossed, wherein the three dimensional identification feature is provided as a depressed design.

It is understood that the three dimensional formed elements 560, 570 can be provided as a series of arranged three dimensional formed elements 560, 570, wherein the arrangement enhances the process of defining the associated connection location of the network jack 200 within the network. This arrangement can be analogous to braille.

In one solution, the region for the three dimensional formed elements 560, 570 can be provided as a volume of wax or other suitable material formable under low heat and/or pressure. The installer would utilize a die to create a formation of the three dimensional formed elements 560, 570 within the volume of suitable material designated therefore.

Figure 10:
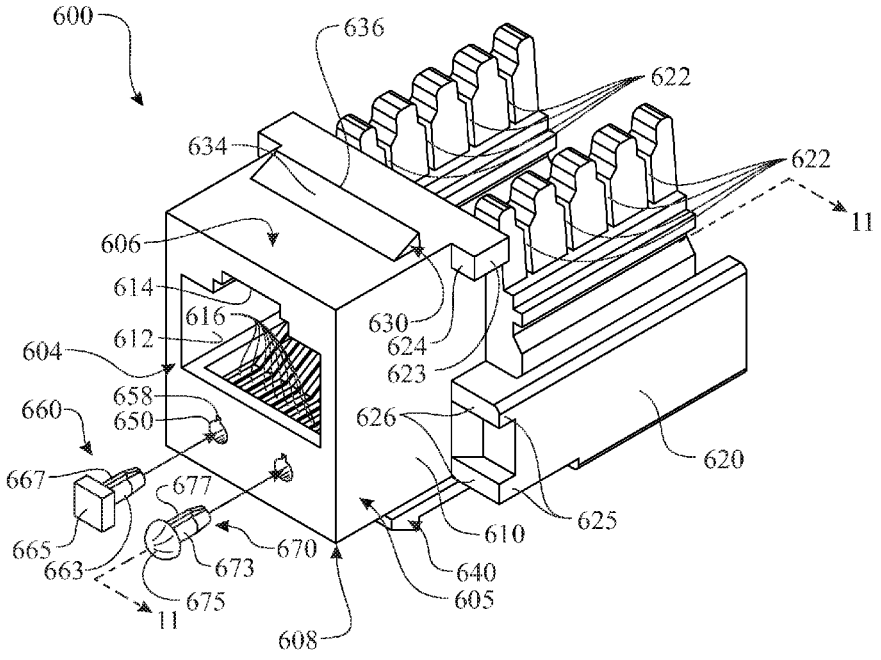
FIG. 10 presents an isometric view illustrating an exemplary variant of the network jack assembly introduced in FIG. 3, wherein the network node identification cavities are accessible through a front surface of the network jack assembly and each associated identifier element includes a three dimensional feature formed at an exposed end of an elongated insertion post.
Figure 11:
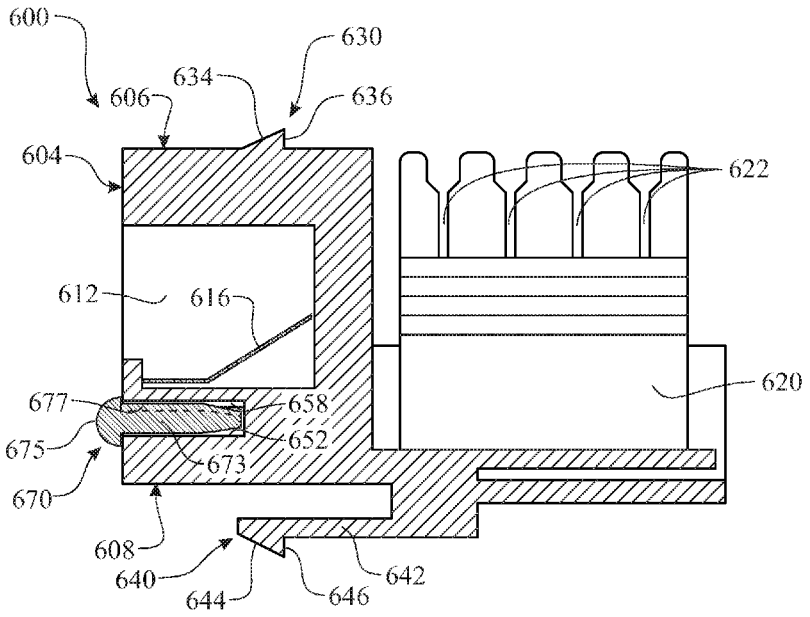
FIG. 11 presents a cross sectioned elevation side view of the exemplary network jack assembly originally introduced in FIG. 10, wherein the section is taken along section line 11-11 of FIG. 10.

In another solution, three dimensional formed elements 665, 675 can be provided at a distal end of an elongated shaft 663, 673, as illustrated in a third variant, referred to as a network jack assembly 600, which is illustrated in an isometric view presented in FIG. 10 and illustrated in a sectioned view presented in FIG. 11, wherein the section is taken along section line 11-11 of FIG. 10. The network jack assembly 600 is a fourth adaptation of the present invention to the network jack assembly 200. More specifically, the network jack assembly 600 is more closely related to the network jack assembly 400. Like features of the network jack assembly 600 and the network jack assembly 400 are numbered the same, wherein the reference numbers are preceded by the numeral "6".

The unique distinction between the network jack assembly 400 and the network jack assembly 600 is the design of the identifier elements 660, 670. Each identifier element 660, 670 includes a three dimensionally formed surface 665, 675 provided at a proximal end of an elongated shaft or an identifier element assembly pin 663, 673. This enables installation of a variety of three dimensional shapes, providing a flexible solution, while minimizing tooling and inventory to the manufacturer, installer, and others involved throughout commercialization of the network jack assemblies 600. Since orientation may affect an interpretation of a shape, the identifier receiving cavity 650 can include an orientation feature. For example, a square shaped three dimensionally formed surface 665, 675 can be installed at a 45° angle defining the shape as a diamond.

The three dimensionally formed surfaces 665, 675 can be of a size that is larger than a diameter of the respective identifier element assembly pin 663, 673. This defines a stop surface, wherein a rear or distal surface of the respective three dimensionally formed surface 665, 675 would seat against the jack assembly front surface 604.

The orientation feature can be a non-circular cross sectional shape, inclusion of an identifier receiving cavity orientation slot 658, or any other known solution. A cross sectional shape of the identifier element assembly pin 663, 673 would be consistent with the cross sectional shape of the identifier receiving cavity 650, whether the identifier receiving cavity 650 is inclusive or exclusive of the identifier receiving cavity orientation slot 658. When inclusive of the identifier receiving cavity orientation slot 658, each identifier element 660, 670 could additionally include an identifier element assembly orientation key 667, 677.

Examples of three dimensionally formed surfaces 665, 675 include circular shapes, hemispherical shapes, triangular shapes, square shapes, diamond shapes, pyramid shapes, trapezoidal shapes, pentagonal shapes, hexagonal shapes, octagonal shapes, five point star shapes, six point star shapes, heart shaped, and the like. The three dimensionally formed surfaces 665, 675 can alternatively be shaped as numbers, letters, or other characters. The three dimensionally formed surfaces 665, 675 enables identification by visual inspection, tactile or feel, and the like. The identifier elements 660, 670 can be of a color matching a color of the body of the network jack assembly 600. This reduces a contrast between the identifier element 660, 670 and the body of the network jack assembly 600, minimizing any visual impact thereof, while retaining the benefits of the unique network connection identity.

Alternatively, the identifier elements 660, 670 can be colored to provide additional features for indexing the respective network jack assembly 600 with the associated network connection node. The colorization can be applied to an exterior surface of the identifier element 660, 670, provided in a selected material when manufacturing each identifier elements 660, 670, and the like.

The various identifying components of the identifier elements 660, 670 can be referred to as an identification feature. The identification feature can be at least one of a color and a three dimensional shape. The inclusion of two or more identifier elements 660, 670 enable the user to select any combination of identification features to create a unique node identifier. The unique node identifier can be at least one of color and the three dimensional shape, or any combination thereof, including an order of the identifier elements 660, 670 when multiple identifier elements 660, 670 are used. The inventory would include sets of identifier elements 660, 670 having like unique node identifiers, each set would be used for identifying one node.

Figure 12:
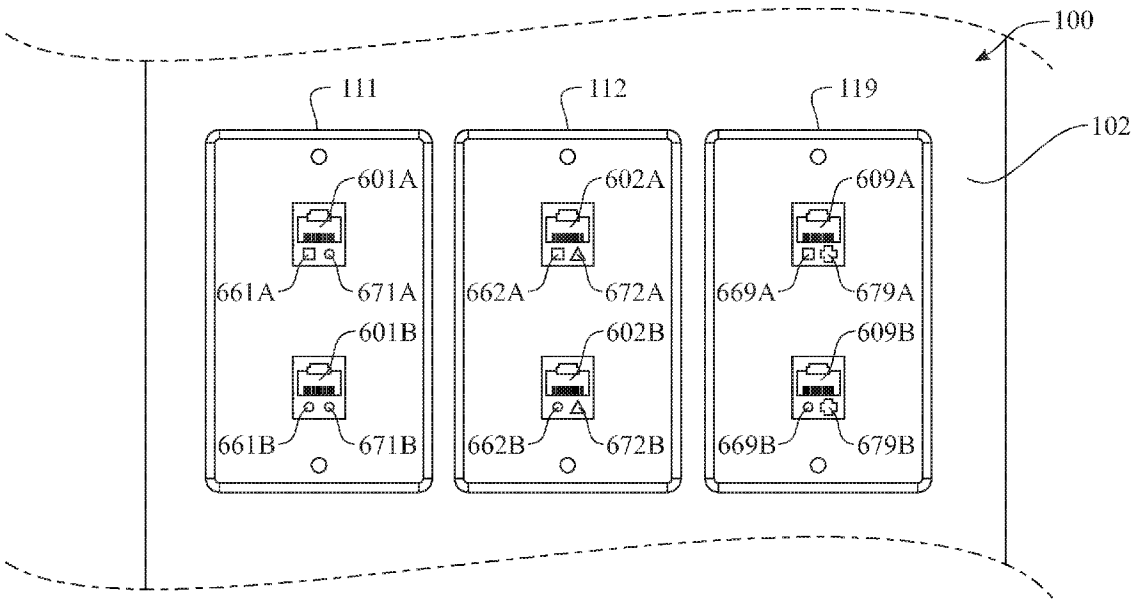
FIG. 12 presents a front view of a series of network jack assemblies introduced in FIG. 10 installed into a plurality of network jack wall plates, wherein the illustration introduces a method of identifying each network and more specifically each associated node of the network to which the network jack assembly is connected thereto.

An exemplary installation of the various network jack assemblies 300, 400, 500, 600 is presented in FIG. 12. The exemplary illustration presents a series of network jack assemblies 600 installed on a wall 102, wherein the network jack assembly 600 would be representative of any of the various network jack assemblies 300, 400, 500, 600. The room section 100 includes three exemplary wall plates 111, 112, 119. Two exemplary network jack assemblies 600 are assembled to each wall plate 111, 112, 119. It is understood that each wall plate 111, 112, 119 can be configured to support any number of network jack assemblies 600, such as a single network jack assembly 600, a pair of network jack assemblies 600, three network jack assemblies 600, four network jack assemblies 600, six network jack assemblies 600, eight network jack assemblies 600, or any other reasonable quantity of network jack assemblies 600.

A first wall plate, first jack assembly 601A and a first wall plate, second jack assembly 601B are installed in the first wall plate 111. The network location associated with the first wall plate, first jack assembly 601A is identified by a square shaped first wall plate, first identifier element of first jack assembly 661A and a circular shaped first wall plate, second identifier element of first jack assembly 671A. The network location associated with the first wall plate, second jack assembly 601B is identified by a circular shaped first wall plate, first identifier element of second jack assembly 661B and a circular shaped first wall plate, second identifier element of second jack assembly 671B.

A second wall plate, first jack assembly 602A and a second wall plate, second jack assembly 602B are installed in the second wall plate 112. The network location associated with the second wall plate, first jack assembly 602A is identified by a square shaped second wall plate, first identifier element of first jack assembly 662A and a triangular shaped second wall plate, second identifier element of first jack assembly 672A. The network location associated with the second wall plate, second jack assembly 602B is identified by a circular shaped second wall plate, first identifier element of second jack assembly 662B and a triangular shaped second wall plate, second identifier element of second jack assembly 672B.

An nth wall plate, first jack assembly 609A and an nth wall plate, second jack assembly 609B are installed in the nth wall plate 119. The network location associated with the nth wall plate, first jack assembly 609A is identified by a square shaped nth wall plate, first identifier element of first jack assembly 669A and a plus shaped nth wall plate, second identifier element of first jack assembly 679A. The network location associated with the nth wall plate, second jack assembly 609B is identified by a circular shaped nth wall plate, first identifier element of second jack assembly 669B and a plus shaped nth wall plate, second identifier element of second jack assembly 679B.

Each of the first identifier elements 661A, 662A, 669A of each respective first jack assembly 601A, 602A, 609A are of like shapes to identify the respective network. In the exemplary embodiment, each respective first jack assembly 601A, 602A, 609A is connected to a first network, such as a telephony network. Similarly, each of the first identifier elements 661B, 662B, 669B of each respective second jack assembly 601B, 602B, 609B are of like shapes to identify the respective network. In the exemplary embodiment, each respective second jack assembly 601B, 602B, 609B is connected to a second network, such as a data network.

Each of the second identifier elements 671A, 672A, 679A of each respective first jack assembly 601A, 602A, 609A are of unique shapes to identify the respective node or connection point within the respective network. Similarly, each of the second identifier elements 671B, 672B, 679B of each respective second jack assembly 601B, 602B, 609B are of unique shapes to identify the respective node or connection point within the respective network. Each network jack of each network would comprise a unique network node identifier, such as 671A, 672A, 679A in the first network and such as 671B, 672B, 679B in the second network.

Shapes of the identifiers can provide one element towards a unique identifier. Color introduces a multiplier to exponentially expand a method to provide unique identifiers.

The previous applications of the concept were integral with the network jack assembly 300, 400, 500, 600. It is also understood that the same identification system can be applied to a wall plate 710, as illustrated in an exemplary embodiment shown in FIG. 13.

The exemplary embodiment introduces details of installation features used to assemble and retain the network jack assembly 200, 300, 400, 500, 600 to the wall plate 710. Although a network jack assembly 600 is shown in the exemplary illustration, it is understood that any network jack assembly 200, 300, 400, 500, 600 can be installed therein.

A jack assembly access port 742 is formed through a wall plate body 740 of the exemplary wall plate 710. A rectangular network jack retention frame extends rearward from a rear surface of the wall plate body 740 of the exemplary wall plate 710. The jack assembly access port 742 would be properly located within the interior of the rectangular network jack retention frame. The jack assembly access port 742 would be shaped and sized to receive the forward portion of the plug body section 610. In an optimal configuration, the peripheral edge of the jack assembly access port 742 would mimic the peripheral edge of the plug body section 610 resulting in a generally concealed seam therebetween. The exemplary illustration includes: a wall plate jack assembly receptacle frame first compression resistance latching panel 744 defining a first horizontal element of the rectangular network jack retention frame; a wall plate jack assembly receptacle frame second compression resistance latching panel 746 defining a second, opposite horizontal element of the rectangular network jack retention frame; and a wall plate jack assembly receptacle frame tensile resistance surface 743, wherein the wall plate jack assembly receptacle frame tensile resistance surface 743 is representative of a pair of vertical elements of the rectangular network jack retention frame.

A wall plate jack assembly receptacle frame first compression resistance surface 745 is formed along a distal or outer edge of the wall plate jack assembly receptacle frame first compression resistance latching panel 744. The fixed jack assembly plate retention feature compression resistance surface 636 engages with the wall plate jack assembly receptacle frame first compression resistance surface 745 to retain the network jack assembly 600 within the exemplary wall plate 710 against a compression or rearwardly applied force. Similarly, a wall plate jack assembly receptacle frame second compression resistance surface 747 is formed along a distal or outer edge of the wall plate jack assembly receptacle frame second compression resistance latching panel 746. The cantilevered jack assembly plate retention feature compression resistance surface 646 engages with the wall plate jack assembly receptacle frame second compression resistance surface 747 to retain the network jack assembly 600 within the exemplary wall plate 710 against a compression or rearwardly applied force.

Each jack assembly first tensile resistance feature contact surface 624 of a jack assembly first tensile resistance feature 623 and each jack assembly second tensile resistance contact surface 626 of a jack assembly second tensile resistance feature 625 seat against a respective wall plate jack assembly receptacle frame tensile resistance surface 743 of the rectangular network jack retention frame as shown in broken lines within the illustration presented in FIG. 12. The engagement between the jack assembly first tensile resistance feature contact surface 624 and the wall plate jack assembly receptacle frame tensile resistance surface 743 as well as the engagement between the jack assembly second tensile resistance contact surface 626 and the wall plate jack assembly receptacle frame tensile resistance surface 743 retain the network jack assembly 600 within the exemplary wall plate 710 against a tensile or forwardly applied force. The network jack assembly 600 is installed by inserting the plug body section 610 into the rectangular network jack retention frame at an angle, engaging the fixed jack assembly plate retention feature compression resistance surface 636 and the wall plate jack assembly receptacle frame first compression resistance surface 745 with one another, then rotating the network jack assembly 600 until the cantilevered jack assembly plate retention feature compression resistance surface 646 engages with the wall plate jack assembly receptacle frame second compression resistance surface 747. A wall plate receptacle frame jack assembly rotational clearance 749 is provided within an interior of the rectangular network jack retention frame to provide clearance for the network jack assembly 600 during the installation process.

In the exemplary embodiment, the exemplary wall plate 710 includes a network connection identifier similar to the identifier receiving cavity 350 of the network jack assembly 300. The exemplary wall plate jack assembly connection identifier receiving cavity 750 is formed within a wall plate body 740 or extending rearward of a rear or interior surface of the wall plate body 740. Access to the wall plate jack assembly connection identifier receiving cavity 750 would be provided through a rear area of the exemplary wall plate 710. Although the wall plate jack assembly connection identifier receiving cavity 750 is drawn as being within a width of the wall plate body 740, it is understood that the wall plate jack assembly connection identifier receiving cavity 750 can extend rearward of a rear or interior surface of the wall plate body 740. A wall plate jack assembly connection identifier receiving cavity lens 752 is can be a clear or translucent lens cover integral with the wall plate jack assembly connection identifier receiving cavity 750, located within a portion of the wall plate jack assembly connection identifier receiving cavity 750 that contributes to a front surface of the wall plate body 740. The wall plate jack assembly connection identifier receiving cavity lens 752 provides visibility to identifier element colored surfaces 765 of an identifier element 760 that would be inserted into the wall plate jack assembly connection identifier receiving cavity 750.

The illustrated exemplary wall plate 710 presented one suggested implementation of the present invention. The location and quantity of the wall plate jack assembly connection identifier receiving cavities 750 can be determined by the designer. It is understood that any of the variants taught above can be integrated into the exemplary wall plate 710.

Each of the configurations of the network jack assembly 300, 400, 500, 600 is exemplified in the illustrations and described herein as an 8P8C network plug and jack. It is understood that the network plug and jack can be adapted to support of any networking configuration, including fiber optic connections, coaxial connections, and the like. Using the network jack assembly 300 as an exemplary reference, is understood that the plug receptacle 312 and the associated receptacle contacts 316 would be adapted to provide connectivity to any associated downstream device, and the terminals 222 would be adapted to provide connectivity to the upstream networking equipment.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

REF NO. DESCRIPTION

100 room section
102 wall
104 flooring
106 baseboard
111 first wall plate
112 second wall plate
119 nth wall plate
169A exemplary first jack assembly identifier
169B exemplary second jack assembly identifier
180A network switch
180B network switch
189A switch to network jack connection link
189B switch to network jack connection link
200 network jack assembly
204 network jack assembly front surface
205 network jack assembly side surface
206 network jack assembly top surface
208 network jack assembly bottom surface
209A exemplary first jack assembly
209B exemplary second jack assembly
210 plug body section
212 plug receptacle
214 receptacle keyway and latch
216 receptacle contact
220 terminal body section
222 terminal
223 jack assembly first tensile resistance feature
224 jack assembly first tensile resistance feature contact surface
225 jack assembly second tensile resistance feature
226 jack assembly tensile resistance feature
230 fixed jack assembly plate retention feature
234 fixed jack assembly plate retention feature lead in surface
236 fixed jack assembly plate retention feature compression resistance surface
240 cantilevered jack assembly plate retention feature
300 network jack assembly
301A first wall plate, first jack assembly
301B first wall plate, second jack assembly
302A second wall plate, first jack assembly
302B second wall plate, second jack assembly
304 jack assembly front surface
305 jack assembly side surface
306 jack assembly top surface
308 jack assembly bottom surface
309A nth wall plate, first jack assembly
309B nth wall plate, second jack assembly
310 plug body section
312 plug receptacle
314 receptacle keyway and latch
316 receptacle contact
320 terminal body section
322 terminal
323 jack assembly first tensile resistance feature
324 jack assembly first tensile resistance feature contact surface
325 jack assembly second tensile resistance feature

326 jack assembly second tensile resistance contact surface
330 fixed jack assembly plate retention feature
334 fixed jack assembly plate retention feature lead in surface
336 fixed jack assembly plate retention feature compression resistance surface
340 cantilevered jack assembly plate retention feature
342 cantilevered jack assembly plate retention feature cantilever arm
344 cantilevered jack assembly plate retention feature lead in surface
346 cantilevered jack assembly plate retention feature compression resistance surface
350 identifier receiving cavity
352 identifier receiving cavity lens
360 first identifier element
361A first wall plate, first identifier element of first jack assembly
361B first wall plate, first identifier element of first jack assembly
362A second wall plate, first identifier element of first jack assembly
362B second wall plate, first identifier element of first jack assembly
365 first identifier element colored surface
369A nth wall plate, first identifier element of first jack assembly
369B nth wall plate, first identifier element of first jack assembly
370 second identifier element
371A first wall plate, second identifier element of first jack assembly
371B first wall plate, second identifier element of first jack assembly
372A second wall plate, second identifier element of first jack assembly
372B second wall plate, second identifier element of first jack assembly
375 second identifier element colored surface
379A nth wall plate, second identifier element of first jack assembly
379B nth wall plate, second identifier element of first jack assembly
400 network jack assembly
404 jack assembly front surface
405 jack assembly side surface
406 jack assembly top surface
408 jack assembly bottom surface
410 plug body section
412 plug receptacle
414 receptacle keyway and latch
416 receptacle contact
420 terminal body section
422 terminal
423 jack assembly first tensile resistance feature
424 jack assembly first tensile resistance feature contact surface
425 jack assembly second tensile resistance feature
426 jack assembly second tensile resistance contact surface
430 fixed jack assembly plate retention feature
434 fixed jack assembly plate retention feature lead in surface
436 fixed jack assembly plate retention feature compression resistance surface
440 cantilevered jack assembly plate retention feature
442 cantilevered jack assembly plate retention feature cantilever arm
444 cantilevered jack assembly plate retention feature lead in surface
446 cantilevered jack assembly plate retention feature compression resistance surface
450 identifier receiving cavity
452 identifier receiving cavity lens
460 first identifier element
465 first identifier element colored surface
470 second identifier element
475 second identifier element colored surface
500 network jack assembly
504 jack assembly front surface
505 jack assembly side surface
506 jack assembly top surface
508 jack assembly bottom surface
510 plug body section
512 plug receptacle
514 receptacle keyway and latch
516 receptacle contact
520 terminal body section
522 terminal
523 jack assembly first tensile resistance feature
524 jack assembly first tensile resistance feature contact surface
525 jack assembly second tensile resistance feature
526 jack assembly second tensile resistance contact surface
530 fixed jack assembly plate retention feature
534 fixed jack assembly plate retention feature lead in surface
536 fixed jack assembly plate retention feature compression resistance surface
540 cantilevered jack assembly plate retention feature
542 cantilevered jack assembly plate retention feature cantilever arm
544 cantilevered jack assembly plate retention feature lead in surface
546 cantilevered jack assembly plate retention feature compression resistance surface
560 first identifier three dimensional formed element
570 second identifier three dimensional formed element
600 network jack assembly
601A first wall plate, first jack assembly
601B first wall plate, second jack assembly
602A second wall plate, first jack assembly
602B second wall plate, second jack assembly
604 jack assembly front surface
605 jack assembly side surface
606 jack assembly top surface
608 jack assembly bottom surface
609A nth wall plate, first jack assembly
609B nth wall plate, second jack assembly
610 plug body section
612 plug receptacle
614 receptacle keyway and latch
616 receptacle contact
620 terminal body section
622 terminal
623 jack assembly first tensile resistance feature
624 jack assembly first tensile resistance feature contact surface
625 jack assembly second tensile resistance feature
626 jack assembly second tensile resistance contact surface
630 fixed jack assembly plate retention feature
634 fixed jack assembly plate retention feature lead in surface
636 fixed jack assembly plate retention feature compression resistance surface

640 cantilevered jack assembly plate retention feature
642 cantilevered jack assembly plate retention feature cantilever arm
644 cantilevered jack assembly plate retention feature lead in surface
646 cantilevered jack assembly plate retention feature compression resistance surface
650 identifier receiving cavity
652 identifier receiving cavity lens
658 identifier receiving cavity orientation slot
660 first identifier element
661A first wall plate, first identifier element of first jack assembly
661B first wall plate, first identifier element of second jack assembly
662A second wall plate, first identifier element of first jack assembly
662B second wall plate, first identifier element of second jack assembly
663 first identifier element assembly pin
665 first identifier element three dimensionally formed surface
667 first identifier element assembly orientation key
669A nth wall plate, first identifier element of first jack assembly
669B nth wall plate, first identifier element of second jack assembly
670 second identifier element
671A first wall plate, second identifier element of first jack assembly
671B first wall plate, second identifier element of second jack assembly
672A second wall plate, second identifier element of first jack assembly
672B second wall plate, second identifier element of second jack assembly
673 second identifier element assembly pin
675 second identifier element three dimensionally formed surface
677 second identifier element assembly orientation key
679A nth wall plate, second identifier element of first jack assembly
679B nth wall plate, second identifier element of second jack assembly
710 exemplary wall plate
740 wall plate body
742 jack assembly access port
743 wall plate jack assembly receptacle frame tensile resistance surface
744 wall plate jack assembly receptacle frame first compression resistance latching panel
745 wall plate jack assembly receptacle frame first compression resistance surface
746 wall plate jack assembly receptacle frame second compression resistance latching panel
747 wall plate jack assembly receptacle frame second compression resistance surface
749 wall plate receptacle frame jack assembly rotational clearance
750 wall plate jack assembly connection identifier receiving cavity
752 wall plate jack assembly connection identifier receiving cavity lens
760 jack assembly network connection identifier element
765 jack assembly network connection identifier element colored surface

What is claimed is:

1. A method of identifying a location of a network jack assembly with a network, the network having a plurality of nodes, each node having a first end located at a network interface component comprising a plurality of first node ends and a second end located distally from the network interface component, a network controller managing network traffic at the network interface component, the method comprising steps of:

obtaining a network jack assembly, the network jack assembly comprising:

a molded network jack body having a front surface, a pair of side surfaces, a top surface, and a bottom surface, a network connection point integral with the network jack body, wherein the network connection point is adapted to provide signal connectivity with an upstream network, and an outbound signal connector integral with the network jack body, wherein the outbound signal connector is adapted to provide signal connectivity with a downstream device, the outbound signal connector being located within a plug receptacle, the plug receptacle extending inward from the front surface, wherein the network connection point and the outbound signal connector are in signal communication with one another, obtaining a wall plate having a front surface;

locating an at least one identifier receiving cavity, wherein the at least one identifier receiving cavity is located in at least one of the molded network jack assembly and the wall plate, wherein said at least one identifier receiving cavity is designed to receive a jack network location identifier, wherein when the jack network location identifier is inserted into the respective identifier receiving cavity, an identifying feature of the jack network location identifier would be visible when viewing front surface of an assembly comprising the molded network jack assembly and wall plate;

obtaining a plurality of jack network location identifiers, each jack network location identifier including an identification feature, the identification feature being at least one of a color and a three dimensional shape, wherein the identification features of at least a portion of the jack network location identifiers of the plurality of jack network location identifiers differ from one another, each jack network location identifier of the plurality of jack network location identifiers having a size and shape suitable for insertion into the identifier receiving cavity;

identifying the first, network interface component end of the node of the network using a unique node identifier, wherein the unique node identifier includes one jack network location identifier or a series of jack network location identifiers, each identifying feature of the jack network location identifier defines a component of the unique node identifier;

locating the second, distal end of the node of the network;

connecting the network connection point of the network jack assembly to the second distal end of the node within the network;

obtaining a matching unique node identifier, wherein the matching unique node identifier matches the unique node identifier identifying the first, network interface component end of the node of the network;

connecting the network connection point of the network jack assembly to the second, distal end of the node within the network;

inserting each at least one jack network location identifier of the matching unique node identifier into each respective at least one identifier receiving cavity;

assembling the network jack assembly to the wall plate; and viewing the identification feature of each at least one jack network location identifier of the unique node identifier from a front surface of the network jack assembly and wall plate assembly to determine the node connectivity of the network jack assembly based upon the unique node identifier identifying the first, network interface component end of the node of the network.

2. A method of identifying a network location of a network jack assembly as recited in claim 1, wherein the at least one identifier receiving cavity is formed within the wall plate, the method further comprising a step of:

inserting the selected at least one jack network location identifier into the respective at least one jack network identification cavity formed within the wall plate.

3. A method of identifying a network location of a network jack assembly as recited in claim 1, wherein the at least one jack network identification cavity extends inward from the front surface of the network jack body the method further comprising a step of:

inserting the selected at least one jack network location identifier into one of the at least one jack network identification cavity from the front surface.

4. A method of identifying a network location of a network jack assembly as recited in claim 1, wherein the network identification cavity extends inward from the front surface of the network jack body, wherein the identification feature of the jack network location identifier is disposed upon a visible end of an elongated assembly element, the elongated assembly element having a shape and size adapted for insertion into the at least one jack network identification cavity, the method further comprising a step of:

inserting the elongated assembly element of the selected at least one jack network location identifier into the respective at least one jack network identification cavity from the front surface, exposing the identification feature of the jack network location identifier.

5. A method of identifying a network location of a network jack assembly as recited in claim 1, wherein at least one jack network identification cavity extends inward from the side surface of network jack body, the method further comprising a step of:

inserting the selected at least one jack network location identifier into one of the at least one jack network identification cavity from the side surface.

6. A method of identifying a network location of a network jack assembly as recited in claim 1, wherein the at least one jack network identification cavity extends inward from the side surface of network jack body, the network jack body further comprising a cavity lens cover integral to a portion of the identification cavity contributing to the front surface of the network jack body, the method further comprising a step of:

inserting the selected at least one jack network location identifier into one of the at least one jack network identification cavity from the side surface, where the identification feature of the selected at least one jack network location identifier is visible through the cavity lens cover.

7. A method of identifying a network location of a network jack assembly as recited in claim 1, wherein the network identification cavity extends inward from the front surface of the network jack body, wherein the identification feature of the jack network location identifier is disposed upon a visible end of an elongated assembly element, the elongated assembly element having a shape and size adapted for insertion into the at least one jack network identification cavity, the identification feature being larger than the elongated assembly element, the method further comprising a step of:

inserting the elongated assembly element of the selected at least one jack network location identifier into the respective at least one jack network identification cavity-from the front surface, wherein the identification feature of the jack network location identifier remains proud of the front surface of the network jack body.

8. A method of identifying a network location of a network jack assembly as recited in claim 1, the method further comprising a step of:

employing both color and the at least one three dimensional shape to identify each of the first end of the node and the second end of the node within the network.

9. A method of identifying a location of a network jack assembly with a network, the network having a plurality of nodes, each node having a first end located at a network interface component comprising a plurality of first node ends and a second end located distally from the network interface component, a network controller managing network traffic at the network interface component, the method comprising steps of:

obtaining a plurality of jack network location identifiers, each jack network location identifier including an identification feature, the identification feature being at least one of a color and a three dimensional shape, the plurality of jack network location identifiers includes multiple sets of unique node identifiers, each unique node identifier includes one jack network location identifier or a series of jack network location identifiers, each identifying feature of the jack network location identifier defines a component of a node identifying code defined by the unique node identifier, wherein unique node identifiers of each set define the same node identifying code, wherein the node identifying code defined by each set of unique node identifiers differs from the other node identifying codes defined by other sets of unique node identifiers;

obtaining a pair of network jack assemblies, each network jack assembly comprising:

a molded network jack body having a front surface, a pair of side surfaces, a top surface, and a bottom surface, at least one jack network identification cavity formed within the molded network jack body, a network connection point integral with the network jack body, wherein the network connection point is adapted to provide signal connectivity with an upstream network, an outbound signal connector integral with the network jack body, wherein the outbound signal connector is adapted to provide signal connectivity with a downstream device, the outbound signal connector being located within a plug receptacle, the plug receptacle extending inward from the front surface, wherein the network connection point and the outbound signal connector are in signal communication with one another, connecting the network connection point of the network jack assembly to a node within a network, and at least one identifier receiving cavity, each at least one identifier receiving cavity designed to receive one jack network location identifier of the plurality of jack network location identifiers, wherein the identification feature would be visible from the molded network jack body front surface when the jack network location identifier is inserted into the respective identifier receiving cavity;

selecting one set of unique node identifiers to identify a respective node within a network;

employing the selected set of unique node identifiers to identify the node within the respective network; and inserting each jack network location identifier of a first portion of the set of selected unique node identifiers into each respective at least one identifier receiving cavity of a first network jack assembly of the pair of network jack assemblies;

assembling the first network jack assembly of the pair of network jack assemblies to the network interface component;

connecting the network connection point of a second network jack assembly of the pair of network jack assemblies to a second end of the node within the network;

inserting each jack network location identifier of a second portion of the set of selected unique node identifiers into each respective at least one identifier receiving cavity of the second network jack assembly of the pair of network jack assemblies; and assembling the second network jack assembly of the pair of network jack assemblies to a wall plate.

10. A method of identifying a network location of a network jack assembly as recited in claim 9, wherein the at least one jack network identification cavity extends inward from the front surface of network jack body, the method further comprising a step of:

inserting the selected at least one jack network location identifier into one of the at least one jack network identification cavity from the front surface.

11. A method of identifying a network location of a network jack assembly as recited in claim 9, wherein the at least one jack network identification cavity extends inward from the front surface of network jack body, wherein the identification feature is disposed upon a visible end of an elongated assembly element, the elongated assembly element having a shape and size adapted for insertion into the at least one jack network identification cavity, the method further comprising a step of:

inserting the elongated assembly element of the selected at least one jack network location identifier into one of the at least one jack network identification cavity from the front surface.

12. A method of identifying a network location of a network jack assembly as recited in claim 9, wherein the at least one jack network identification cavity extends inward from the side surface of network jack body, the method further comprising a step of:

inserting the selected at least one jack network location identifier into one of the at least one jack network identification cavity from the side surface.

13. A method of identifying a network location of a network jack assembly as recited in claim 9, wherein the at least one jack network identification cavity extends inward from the side surface of network jack body, the network jack assembly further comprising a cavity lens cover integral to a portion of the identification cavity contributing to the front surface of the network jack body, the method further comprising a step of:

inserting the selected at least one jack network location identifier into one of the at least one jack network identification cavity from the side surface, where the identification feature is visible through the cavity lens cover.

14. A method of identifying a location of a network jack assembly with a network, the network having a plurality of nodes, each node having a first end located at a network interface component comprising a plurality of first node ends and a second end located distally from the network interface component, a network controller managing network traffic at the network interface component, the method comprising steps of:

obtaining a plurality of jack network location identifiers, each jack network location identifier of the plurality of jack network location identifiers comprising an identification feature, the identification feature being at least one of a color and a three dimensional shape, the plurality of jack network location identifiers includes multiple sets of jack network location identifiers, wherein each set of jack network location identifiers includes matching identification features, wherein the identification features of multiple sets of jack network location identifiers are different from one another;

obtaining a network jack assembly, comprising:

a molded network jack body having a front surface, a pair of side surfaces, a top surface, and a bottom surface, /8 a network connection point integral with the network jack body, wherein the network connection point is adapted to provide signal connectivity with an upstream network, and an outbound signal connector integral with the network jack body, wherein the outbound signal connector is adapted to provide signal connectivity with a downstream device, the outbound signal connector being located within a plug receptacle, the plug receptacle extending inward from the front surface, wherein the network connection point and the outbound signal connector are in signal communication with one another, obtaining a network jack assembly wall plate, comprising:

a wall plate body having a front surface, and at least one jack assembly access port formed through the wall plate body;

selecting one set of jack network location identifiers of the plurality of jack network location identifiers, the selected set of jack network location identifiers having a unique identification feature, the selected set of jack network location identifiers defining a unique identity of the respective node of the network;

assembling a first portion of the selected jack network location identifiers to an element at the first, network interface component end of the node;

locating an at least one identifier receiving cavity, wherein the at least one identifier receiving cavity is located in at least one of the molded network jack assembly and the wall plate, wherein said at least one identifier receiving cavity is designed to receive a jack network location identifier, wherein when the jack network location identifier is inserted into the respective identifier receiving cavity, the identifying feature of the jack network location identifier would be visible when viewing a front surface of an assembly comprising the molded network jack assembly and wall plate, inserting a second portion of the selected set of jack network location identifiers into the respective at least one identifier receiving cavity formed within one of the molded network jack body and the wall plate body;

assembling the network jack assembly to one of the at least one jack assembly access port of the wall plate body;

connecting the network connection point of the network jack assembly to the second, distal end of the node within the network; and viewing the identification feature of each at least one jack network location identifier from a front surface of the network jack assembly and wall plate assembly to determine the node connectivity of the network jack assembly based upon the at least one of a color and a three dimensional shape identifying the first, network interface component end of the node of the network.

15. A method of identifying a network location of a network jack assembly as recited in claim 9, the method further comprising a step of:

employing both color and the at least one three dimensional shape to identify each of the first end of the node and the second end of the node within the network.

16. A method of identifying a network location of a network jack assembly as recited in claim 14, wherein the at least one jack network identification cavity extends inward from the front surface of the at least one of the network jack body and the front surface of the wall plate body, the method further comprising a step of:

inserting the selected at least one jack network location identifier into one of the at least one jack network identification cavity from the front surface.

17. A method of identifying a network location of a network jack assembly as recited in claim 14, wherein the at least one jack network identification cavity extends inward from at least one of the front surface of network jack body and the front surface of the wall plate body, the identification feature disposed upon a visible end of an elongated assembly element, the elongated assembly element having a shape and size adapted for insertion into the at least one jack network identification cavity, the method further comprising a step of:

inserting the elongated assembly element of the selected at least one jack network location identifier into one of the at least one jack network identification cavity from the front surface.

18. A method of identifying a network location of a network jack assembly as recited in claim 14, wherein the at least one jack network identification cavity extends inward from the side surface of network jack body and a rear of the wall plate body, the method further comprising a step of:

inserting the selected at least one jack network location identifier into one of the at least one jack network identification cavity from the respective one of the side surface of the network jack body and the rear surface of the wall plate body.

19. A method of identifying a network location of a network jack assembly as recited in claim 14, wherein the at least one jack network identification cavity extends inward from the side surface of network jack body, a cavity lens cover integral to a portion of the identification cavity contributing to the front surface of the one of the network jack body and the wall plate body, the method further comprising a step of:

inserting the selected at least one jack network location identifier into the respective at least one jack network identification cavity formed within the at least one of the network jack body and the wall plate body, where the identifying feature is visible through the cavity lens cover.

20. A method of identifying a network location of a network jack assembly as recited in claim 14, the method further comprising a step of:

employing both color and the at least one three dimensional shape to identify each of the first end of the node and the second end of the node within the network.

21. A method of identifying a network location of a network jack assembly as recited in claim 14, wherein the step of assembling a first portion of the selected jack network location identifiers to an element at the first, network interface component end of the node is accomplished in accordance with the following steps:

obtaining a second network jack assembly, the second network jack assembly comprising at least one identifier receiving cavity;

inserting the first portion of the selected jack network location identifiers into the respective at least one identifier receiving cavity of the second network jack assembly, wherein the identifying feature of the first portion of the selected jack network location identifiers is visible from a front surface of the second network jack assembly.

* * * * *